US010962180B2

(12) United States Patent
Cacciabeve

(10) Patent No.: US 10,962,180 B2
(45) Date of Patent: Mar. 30, 2021

(54) HANDHELD CLAMP WORK LIGHT

(71) Applicant: Walter R. Tucker Enterprises, Ltd., Deposit, NY (US)

(72) Inventor: Robert Cacciabeve, Boonton, NJ (US)

(73) Assignee: Walter R. Tucker Enterprises, Ltd., Deposit, NY (US)

( * ) Notice: Subject to any disclaimer, the term of this patent is extended or adjusted under 35 U.S.C. 154(b) by 0 days.

(21) Appl. No.: 16/749,637

(22) Filed: Jan. 22, 2020

(65) Prior Publication Data

US 2021/0033248 A1 Feb. 4, 2021

Related U.S. Application Data

(60) Provisional application No. 62/881,660, filed on Aug. 1, 2019.

(51) Int. Cl.

| | |
|---|---|
| ***F21L 4/04*** | (2006.01) |
| ***F21V 21/088*** | (2006.01) |
| ***F21V 21/096*** | (2006.01) |
| ***F21V 21/30*** | (2006.01) |
| ***F21V 21/14*** | (2006.01) |
| ***F21V 21/40*** | (2006.01) |
| ***F21W 131/402*** | (2006.01) |
| ***F21Y 115/10*** | (2016.01) |
| ***F21Y 103/20*** | (2016.01) |
| ***F21V 23/04*** | (2006.01) |

(52) U.S. Cl.

CPC ..... *F21L 4/04* (2013.01); *F21V 21/0885* (2013.01); *F21V 21/0965* (2013.01); *F21V 21/145* (2013.01); *F21V 21/30* (2013.01); *F21V 21/406* (2013.01); *F21V 23/0414* (2013.01); *F21W 2131/402* (2013.01); *F21Y 2103/20* (2016.08); *F21Y 2115/10* (2016.08)

(58) Field of Classification Search

CPC .... F21L 4/04; F21V 21/0885; F21V 21/0965; F21V 21/145; F21V 21/30; F21V 21/406; F21V 23/0414; F21Y 2103/20; F21W 2131/402

See application file for complete search history.

(56) References Cited

U.S. PATENT DOCUMENTS

| | | | | |
|---|---|---|---|---|
| 5,420,767 | A * | 5/1995 | Jones | F21L 15/14 362/109 |
| 6,585,400 | B2 | 7/2003 | Leon | |
| 7,040,783 | B1 | 5/2006 | Christianson | |
| 7,478,917 | B2 | 1/2009 | Yu | |
| 7,850,329 | B2 | 12/2010 | Henry et al. | |
| 8,025,420 | B2 | 9/2011 | Henry et al. | |
| 8,087,797 | B2 | 1/2012 | Pelletier et al. | |

(Continued)

OTHER PUBLICATIONS

Christopher Rice, "What are "COB" LEDs and Why Do They Matter?", Oct. 12, 2017, Silicon Lightworks, pp. 1-4.*

(Continued)

*Primary Examiner* — Alan B Cariaso

(74) *Attorney, Agent, or Firm* — Breiner & Breiner, L.L.C.

(57) ABSTRACT

A handheld clamp work light is disclosed having a light member, a housing member for movement of the light member, a handle member having a handle housing and a clamp member, and the handle housing and the clamp member include feet members which pivot and may be attached to an object.

16 Claims, 11 Drawing Sheets

(56) References Cited

U.S. PATENT DOCUMENTS

| | | | | |
|---|---|---|---|---|
| 8,142,045 | B2 | 3/2012 | Peak | |
| 8,262,246 | B2 | 9/2012 | Pelletier et al. | |
| 8,348,454 | B2 | 1/2013 | Henry et al. | |
| 8,764,253 | B2 | 7/2014 | Ko et al. | |
| 8,777,446 | B2 * | 7/2014 | Sharrah | F21V 21/0885 362/199 |
| 8,840,264 | B2 | 9/2014 | Molina et al. | |
| 8,911,103 | B2 | 12/2014 | Matthews et al. | |
| D737,487 | S | 8/2015 | Beckett et al. | |
| 9,115,878 | B2 | 8/2015 | Ancona et al. | |
| D786,660 | S | 5/2017 | Cacciabeve | |
| 9,638,379 | B2 * | 5/2017 | Sun | F21V 21/0965 |
| 2003/0007355 | A1 * | 1/2003 | Leen | F21V 21/0885 362/287 |
| 2005/0265033 | A1 * | 12/2005 | Yang | F21V 21/0885 362/398 |
| 2009/0059607 | A1 * | 3/2009 | Yoon | F21V 21/0885 362/396 |
| 2010/0238653 | A1 * | 9/2010 | Pelletier | F21V 21/406 362/191 |
| 2014/0126192 | A1 * | 5/2014 | Ancona | F21V 21/0885 362/191 |
| 2015/0267902 | A1 * | 9/2015 | Zhang | F21L 4/04 362/188 |
| 2017/0314769 | A1 | 11/2017 | Cacciabeve | |

OTHER PUBLICATIONS

DeWalt 20-Volt MAX Cordless LED Worklight, https://www.homedepot.com, Jan. 1, 2019, 4 Pages.

Lutec 1500-Lumen Portable Integrated LED Work Light, https://homedepot.com, Jan. 1, 2019, 5 Pages.

Ridgid LED Lighting Solutions, https://www.toolboxbuzz.com, Jan. 1, 2019, 14 Pages.

Klein Tools, Clamp Work Light, https://www.google.com, Jul. 7, 2020, 6 Pages.

Stanley Heavy Duty Clamping Flashlight, https://toolgyd.com, Jul. 7, 2020, 7 Pages.

Craftsman 3000-Lumen LED Portable Work Light, https://lowes.com, Jul. 7, 2020, 10 Pages.

Blackfire Clamp Light Mini + LED Work Light, https://www.homedepot.com, Jul. 6, 2020, 3 Pages.

KL1017, LED Portable Flash Light & Work Light, www.uninex.com, Aug. 27, 2020, 2 Pages.

* cited by examiner

HANDHELD CLAMP WORK LIGHT

RELATED APPLICATION

This application claims benefit of U.S. Provisional Application Ser. No. 62/881,660, filed Aug. 1, 2019, entitled "Handheld Clamp Work Light," which application is incorporated herein by reference in its entirety.

FIELD OF THE INVENTION

The present invention relates to a handheld clamp work light. More particularly, the invention relates to a handheld clamp work light having a light member, a housing member for movement of the light member, a handle member having a handle housing and a clamp member, and the handle housing and the clamp member include feet members which pivot and may be attached to an object.

BACKGROUND OF THE INVENTION

Homeowners, garage mechanics and the like often require a light source for the work area or other environment of use (collectively "work area"). The light source must be capable of being directed to the work area and configured such that the user does not need to hold on to the light. It is desirable to have a handheld clamp work light which may be held by the user, which may stand on its own, which may be clamped to an object, or which may be attached to an object by an attachment member such as a magnet or a hook member, all for directing the light source to the work area. There are various portable lights available on the market providing one or more of these desired attributes. However, these known devices, while useful, have various shortcomings and improvement over these known devices is desirable. Accordingly, the shortcomings of these known devices are addressed by the present invention.

SUMMARY OF THE INVENTION

A primary object of the invention is to provide a handheld clamp work light.

Another primary object of the invention is to provide for a handheld clamp work light which may be handheld or attached to an object or which is free standing.

Another primary object of the invention is to provide for a handheld clamp work light having a clamp which is easily attached to a surface adjacent to a work area.

Another primary object of the invention is to provide for a handheld clamp work light that has a clamp member that allows the light to be clamped onto most surfaces and aimed in almost any direction through a double axis movement connection.

Another primary object of the invention is to provide for a handheld clamp work light which allows the light to be directed in multiple directions. The light may be directed up or down on a first axis and the light may be rotated 360 degrees on a second axis.

Another primary object of the invention is to provide for a handheld clamp work light that can be clamped to almost any angle surface based on the use of swivel feet having pivoting members to adjust their angle of attachment. The swivel feet may include a cross-check pattern on the feet to securely hold the feet to a flat or round surface such as a pipe, a piece of wood or other object.

Another primary object of the invention is to provide for a handheld clamp work light which includes a magnet located in the handle member to allow the light to be attached to metal surfaces such that the light may move in multiple directions.

Another primary object of the invention is to provide for a handheld clamp work light having a pivoting hook member which may be stored out of the way on the light housing when not in use or having the ability to hang from an object in a work area to direct the light source to the work area.

Another primary object of the invention is to provide for a handheld clamp work light which may be battery operated or which may include a USB rechargeable battery source.

Another primary object of the invention is to provide for a handheld clamp work light which is easy to use, simple in construction, easy to manufacture and provides multiple means for directing the light to the work area, including providing hands free lighting.

The handheld clamp work light invention comprises a light member, a housing member for movement of the light member, a handle member having a handle housing and a clamp member, and the handle housing and the clamp member include feet members which pivot and may be attached to an object.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers.

Referring to the drawings.

DETAILED DESCRIPTION OF THE PREFERRED EMBODIMENTS

Figure 1:
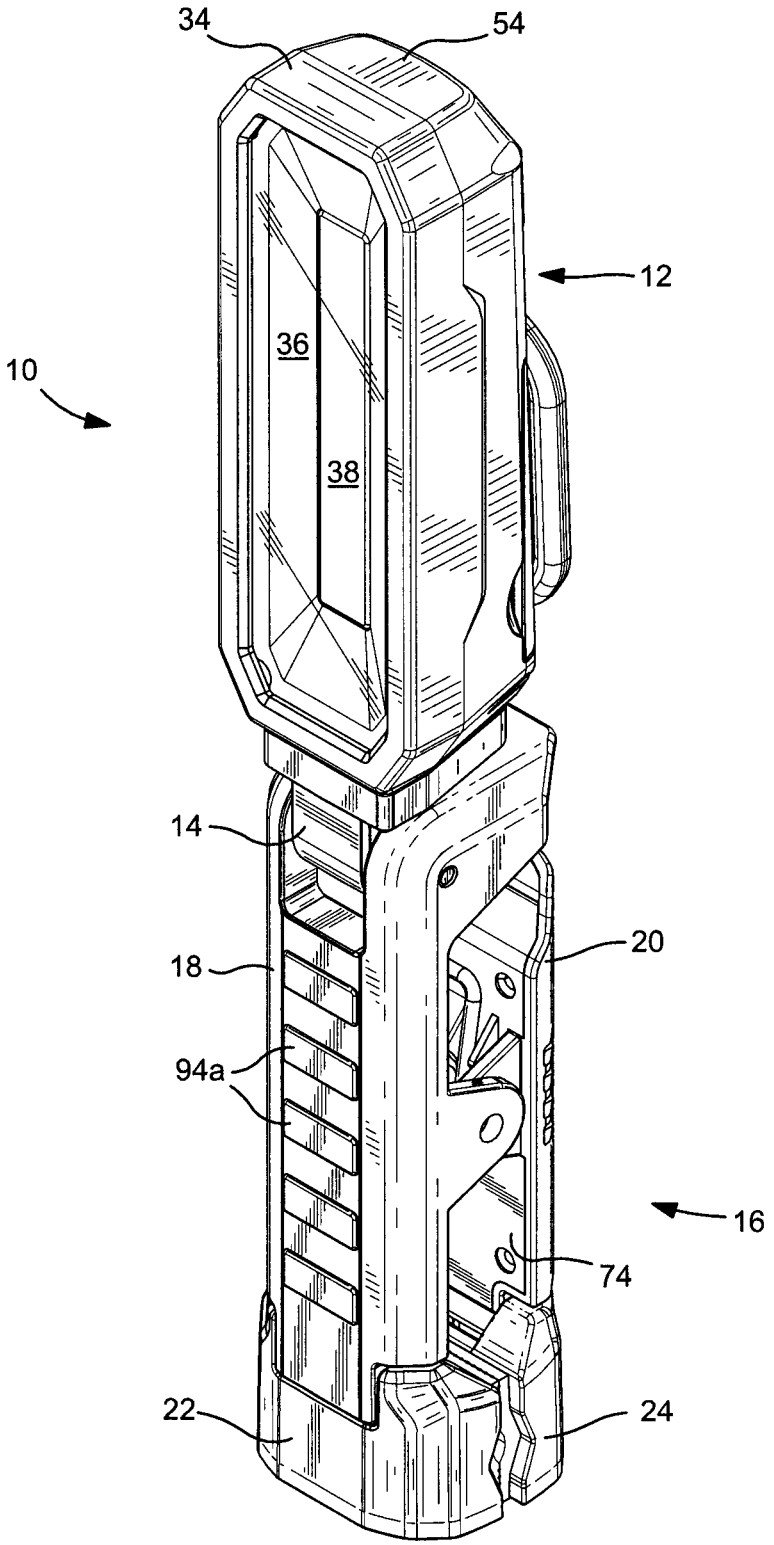
FIG. 1 is a front/side elevational perspective view of the handheld clamp work light.
Figure 2:
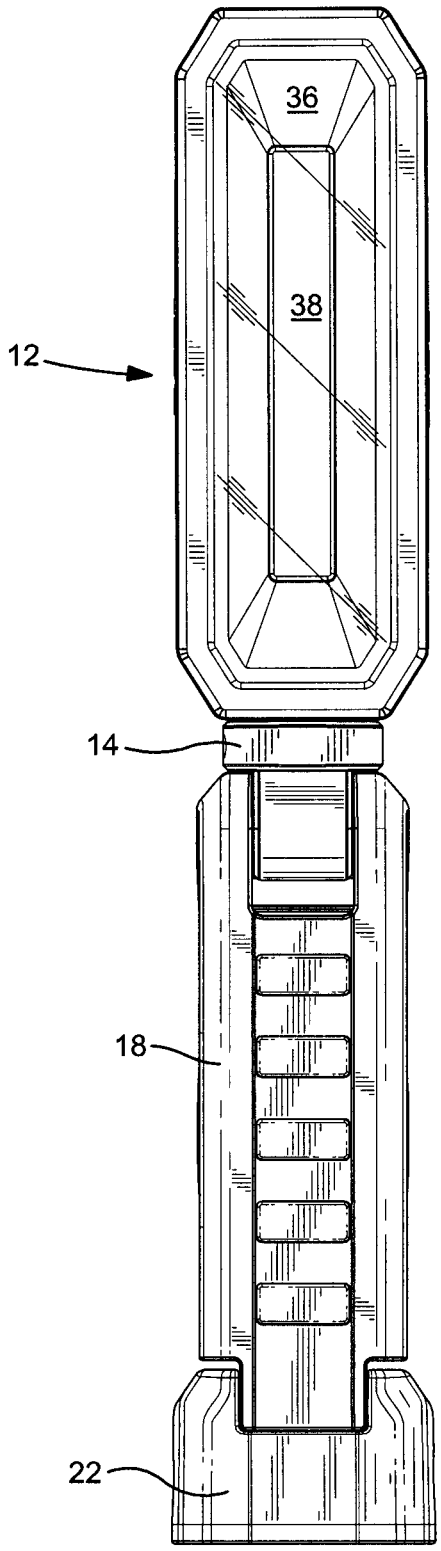
FIG. 2 is a front view of the light of FIG. 1.
Figure 3:
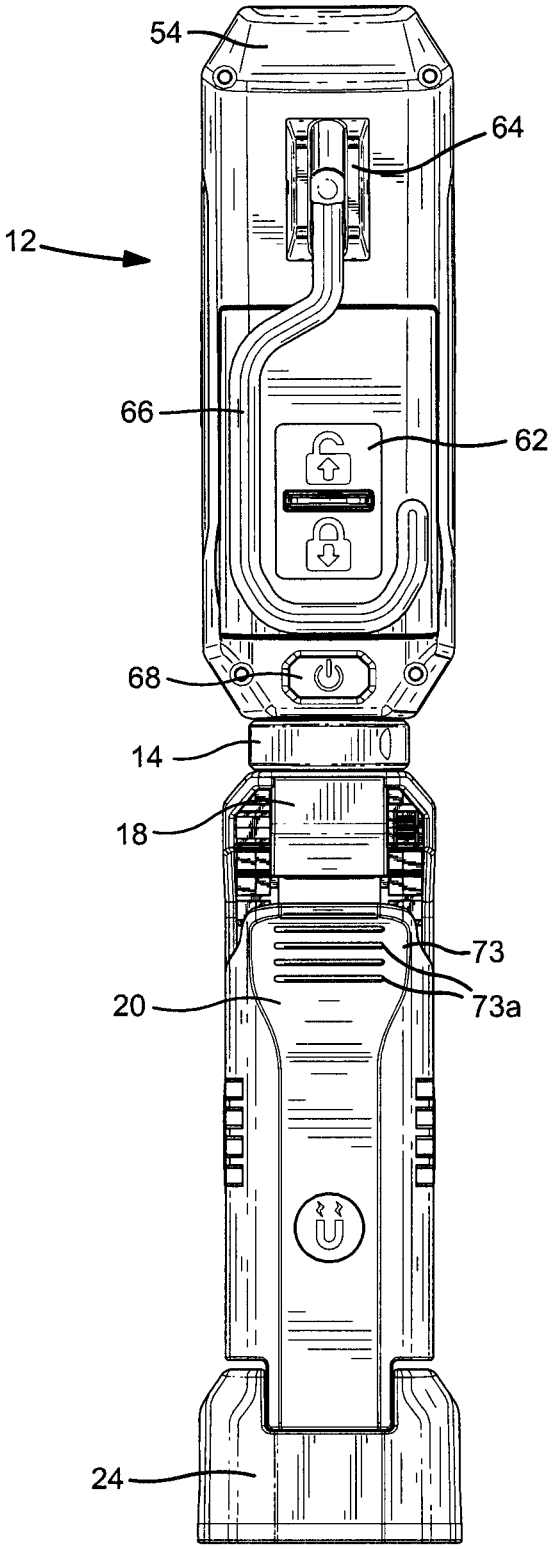
FIG. 3 is a rear view of the light of FIG. 1.
Figure 4:
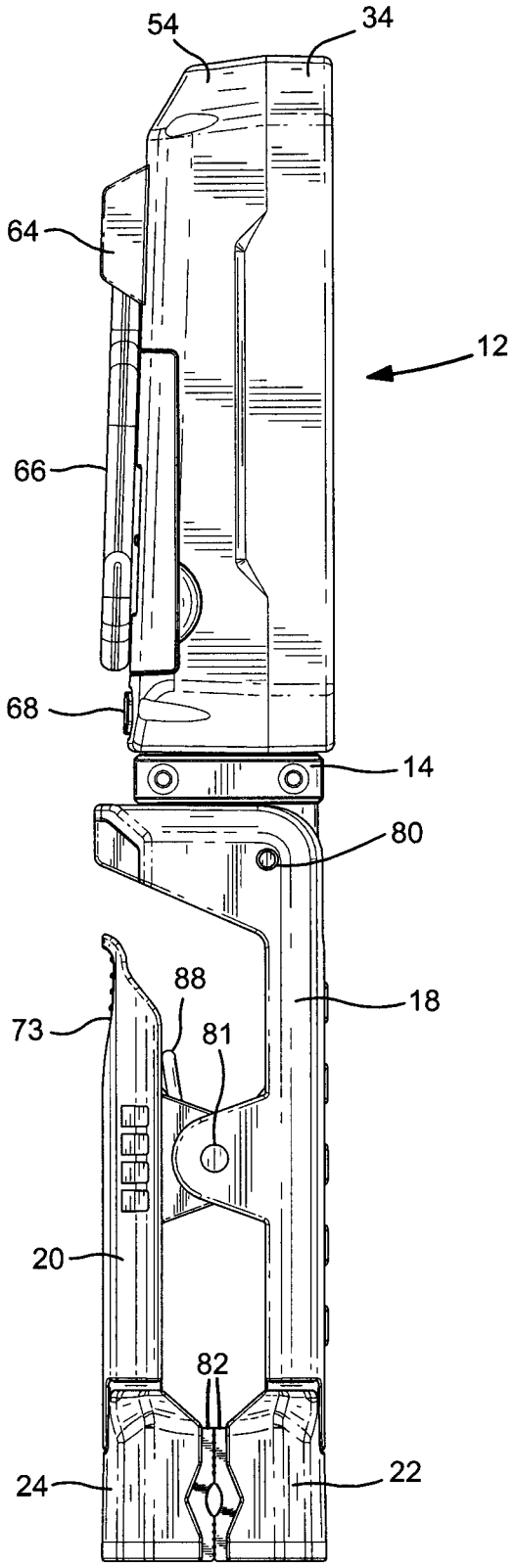
FIG. 4 is a first side view of the light of FIG. 1.
Figure 5:
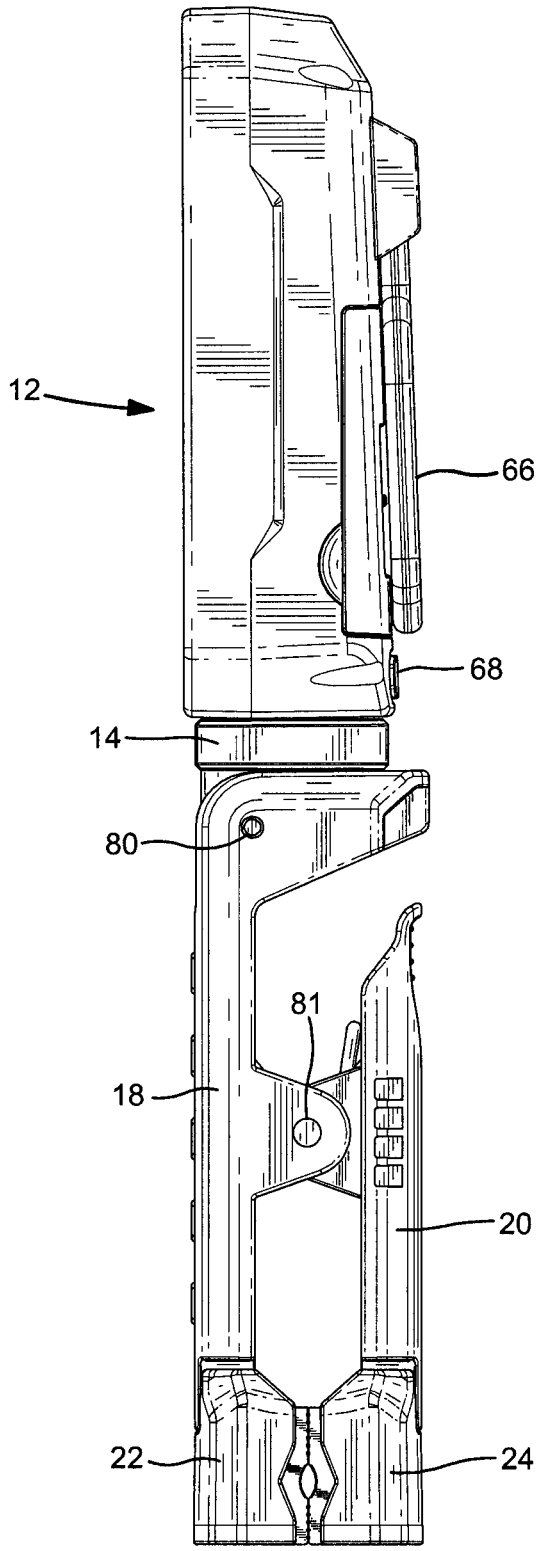
FIG. 5 is a second side view of the light of FIG. 1.
Figure 6:
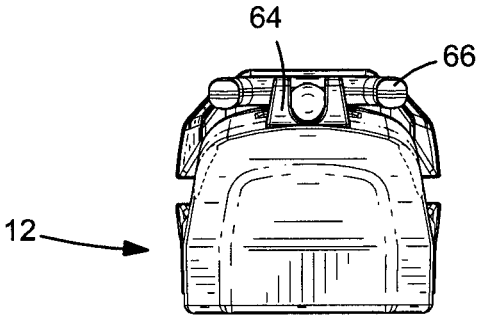
FIG. 6 is a top view of the light of FIG. 1.
Figure 7:
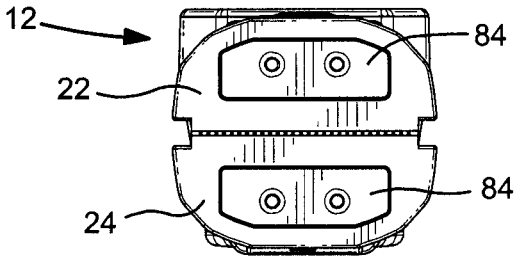
FIG. 7 is a bottom view of the light of FIG. 1.

The present invention is directed to a handheld clamp work light. More particularly, the invention relates to a handheld clamp work light having a light member, a housing member for movement of the light member, a handle member having a handle housing and a clamp member, and the handle housing and the clamp member include feet members which pivot and may be attached to an object. The invention may be used to direct light to a work area from multiple positions.

Referring to the drawings, the invention is directed to a handheld clamp work light 10 comprising a light member 12, a housing member 14 for movement of the light member 12, a handle member 16 comprising a handle housing 18 and a clamping member 20, and pivoting feet members 22 and 24. The light member 12 may rotate 360 degrees or be pivoted 90 degrees to multiple positions. As seen in FIGS. 1-7, the front, rear, sides, top and bottom portions of handheld clamp work light 10 provide for a generally rectangular configuration. This configuration provides for an aesthetically pleasing appearance, and also provides for ease of handling and use of the light and ease of storage of the light.

Figure 8:
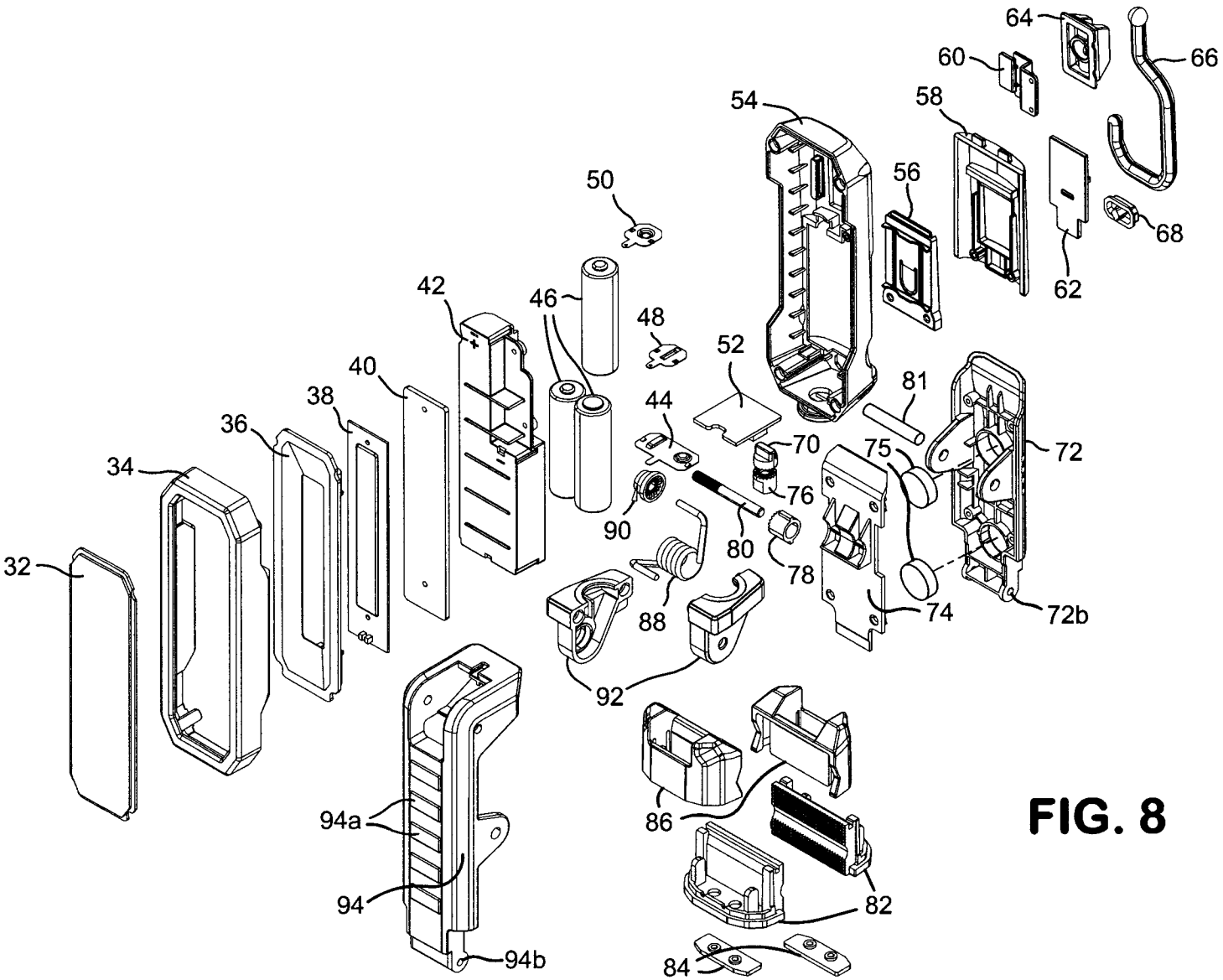
FIG. 8 is an exploded view of the light of FIG. 1.

Referring to FIG. 8, there is shown an exploded view of the handheld clamp work light invention. This exploded view includes components of the handheld clamp work light and a method of construction of the handheld clamp work light. The components of the light as shown in FIG. 1 include the following:

32. CLEAR LENS COVER
34. FRONT BEZEL HOUSING
36. REFLECTOR
38. LED COB
40. HEAT SINK
42. BATTERY HOUSING
44. BATTERY BUS BAR
46. BATTERIES
48. BATTERY SOCKET PIN 2
50. BATTERY SOCKET PIN 3
52. ROTATION ANCHOR
54. BACK HOUSING
56. BATTERY DOOR RECEPTACLE
58. BATTERY DOOR SWITCH HOUSING
60. POWER SWITCH BUTTON
62. BATTERY DOOR UNLOCK/LOCK
64. HOOK HOUSING
66. ROTATING BALL JOINT HOOK
68. SWITCH
70. ROTATING DETENT TOP
72. BACK COVER AND MAGNET HOUSING
74. INTERNAL MAGNET/SPRING HOUSING
75. MAGNETS
76. ROTATING DETENT BOTTOM
78. VERTICAL DETENT
80. PIN
81. PIN
82. RUBBER FEET PLATE
84. RUBBER FEET PLATE STOP
86. ROTATING FEET
88. SPRING
90. VERTICAL DETENT 2
92. ROTATION HOUSING COVER
94. FRONT RIBBED HANDHELD PANEL

One skilled in the art will fully understand the construction and operation of the handheld clamp work light from this FIG. 8 and the other figures.

Referring to the Figures, the light member 12 is attached to housing 14 and housing 14 is attached to handle member 16. Handle member 16 includes a handle housing 18 and a clamping member 20. Attached to handle housing 18 and clamping member 20 are pivoting feet members 22 and 24. As stated, the light 10 may be held in the hand by the user holding handle housing 16; may stand on feet members 22 and 24; may be clamped to an object by handle housing 18 and clamping member 20 and pivoting feet members 22 and 24; may be held on an object by magnets 75 in clamping member 20; or may be held on an object by a hook member 66. The light member 12 may rotated 360 degrees or may pivot up to 90 degrees to multiple positions to provide light in almost any direction in relation to a work area. In a preferred embodiment, the primary components of light 10 are made of plastic. The above components of the invention will now be described in further detail.

Light member 12 includes the light source and the operating components for the light source. A preferred light source is an LED COB light source. The light member 12 includes the following components, including as shown in FIG. 8, clear lens cover 32, front bezel housing 34, reflector 36, LED COB 38, heat sink 40, battery housing 42 for receiving batteries, battery bus bar 44, batteries 46, battery socket pin 48, battery socket pin 50, rotation anchor 52, back housing 54, battery door receptacle 56, battery door switch housing 58, power switch button 60, battery door unlock/lock 62, hook housing 64, rotating ball joint hook 66, and switch 68.

Figure 11:
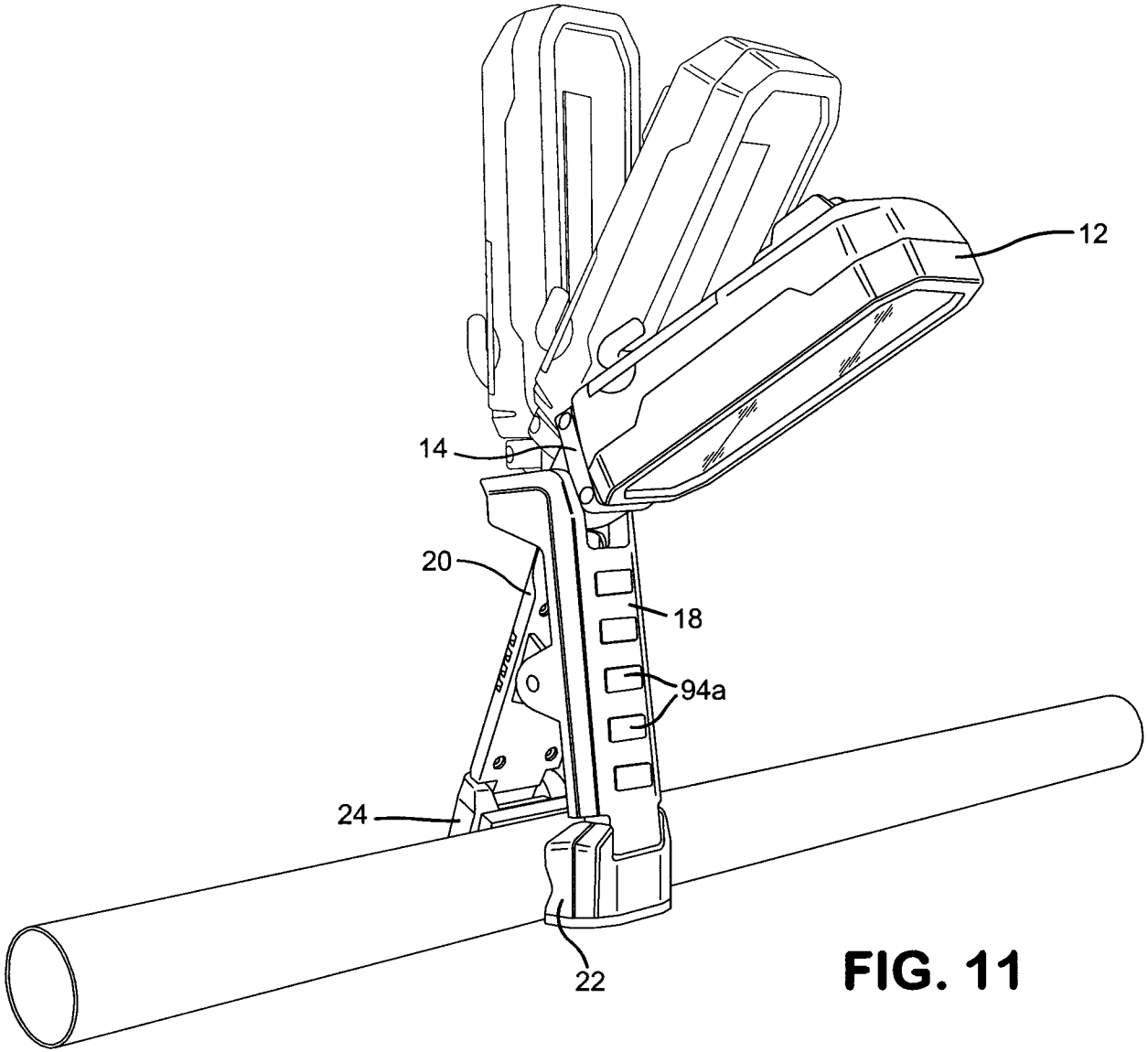
FIG. 11 is a view of the light of FIG. 1 clamped to an object and illustrating the pivoting movement of the light member of the light.
Figure 12:
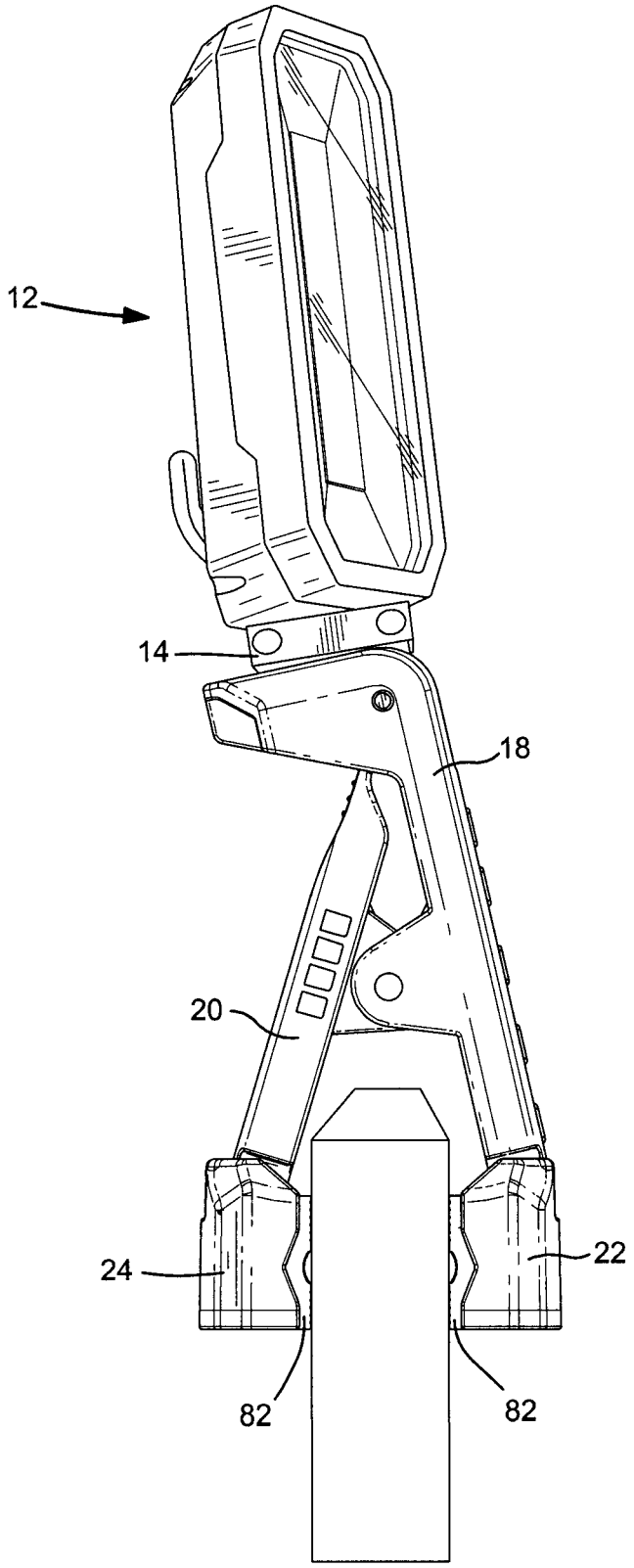
FIG. 12 is a view of the light of FIG. 1 clamped to an object and illustrating the rotating movement of the light member of the light.

Housing 14 is adapted to provide for movement of light member 12 and light member 12 is attached thereto. Housing 14 comprises rotation housing cover 92, vertical detent 90, pin 80, vertical detent 78, and rotating detent top 70 and bottom 76. The vertical detents 90 and 78 provide for vertical movement, preferably ratcheting movement, of light member 12 on pin 80 in relation to handle member 16 as shown in FIG. 11. The vertical movement may provide for 90 degrees of rotation of light member 12 in conjunction with housing 14 on pin 80 in relation to handle member 16. Rotating detents 70 and 76 provide for 360° rotation movement, preferably ratcheting movement, of light member 12 in relation to housing 14 as shown in FIG. 12.

Handle member 16 comprises a handle housing 18 and a clamping member 20. These members further comprise front ribbed handheld panel 94, back cover and magnet housing 72 for receiving a magnet, internal magnet/spring housing 74 attached to housing 72, magnets 75 and spring 88. Front ribbed panel 94 includes a plurality of ribs 94*a* for gripping handle housing 18 when holding the handheld clamp work light 10. The clamping member 20 includes housing 72 which includes a thumb member 73 with ribs 73*a* for applying pressure to clamping member 20 for clamping movement through torsion spring 88 on pin 81 as shown in FIG. 9.

As referenced above, handle housing 18 and clamping member 20 have attached thereto pivoting feet members 22 and 24. These feet members further comprise rotating feet members 86, rubber feet plates 82 attached to rotating feet members 86 and rubber feet plate stops 84. Rubber feet plates 82 may be generally V-shaped having a cross-checkered pattern to securely hold the feet to an object. Feet members 22 and 24 will pivot on pins (not shown) extending through openings 94*b* and 72*b* and mating with corresponding openings in housing 82 and 86.

Figure 9:
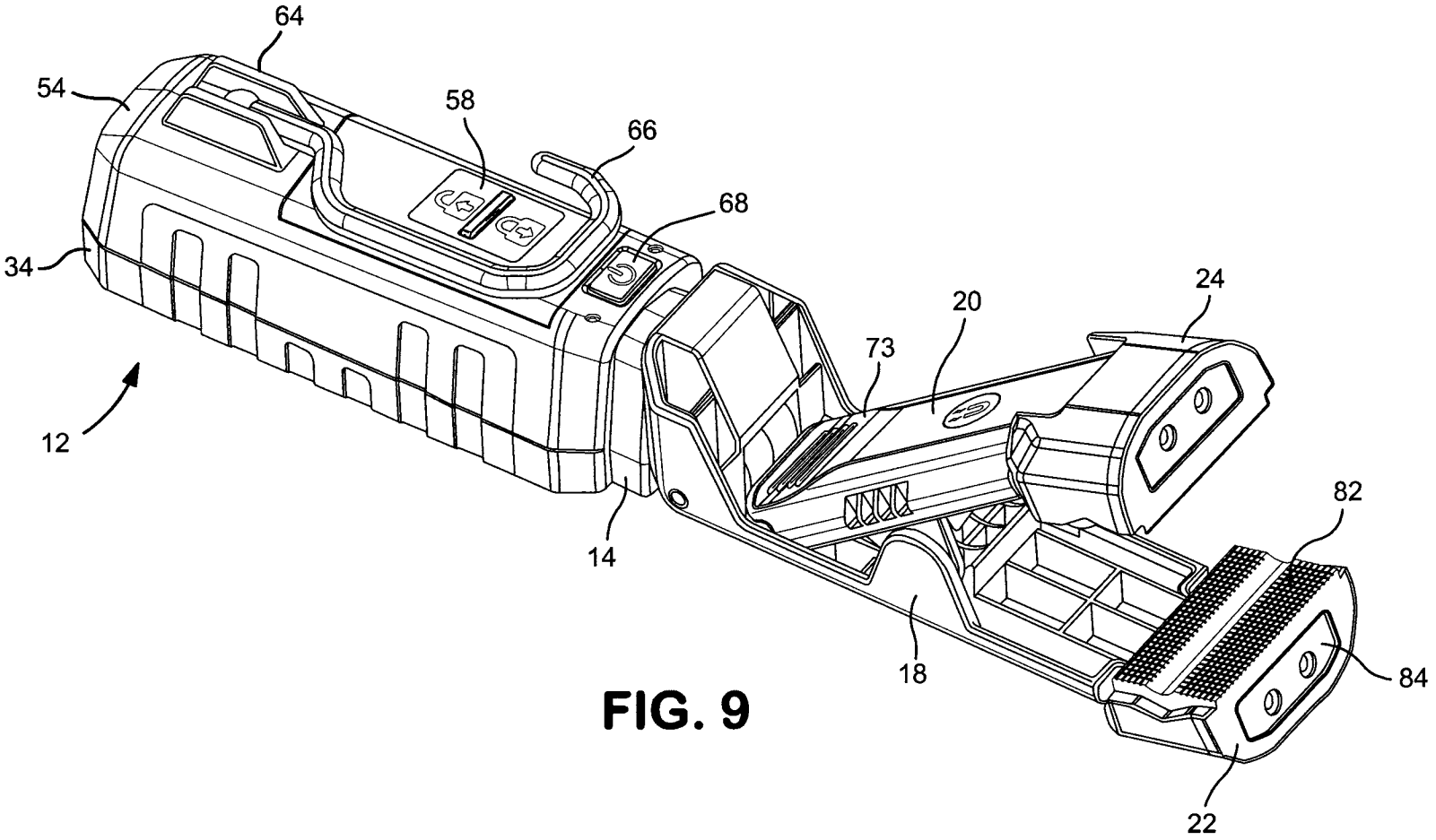
FIG. 9 is a side/back view of the light of FIG. 1 with the clamp member of the handle housing is in an open position for clamping to an object.

Referring to FIG. 9, there is shown a side/back view of the light of FIG. 1 with the clamp member 20 of the handle member 16 in an open position for clamping to an object. Pivoting feet members 22 and 24 are shown in a pivoting position and adapted to be clamped to an object.

Figure 10:
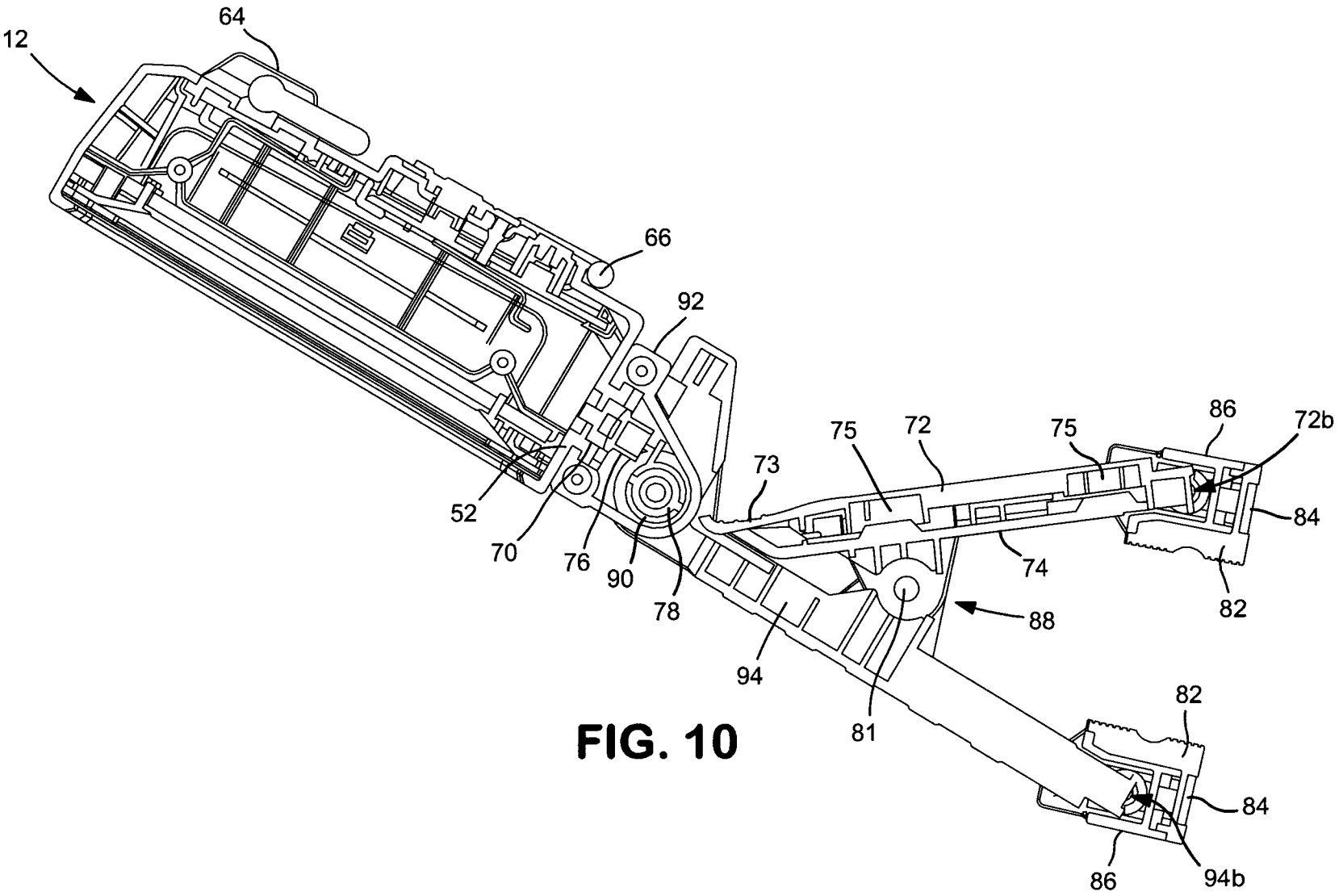
FIG. 10 is a partial cross-sectional side view of the light of FIG. 9 showing the clamping mechanism in an open position for clamping to an object.

Referring to FIG. 10, there is shown a partial cross-section illustrating various parts of the handheld clamping work light 10.

In use, the light is turned on by pushing light switch 68 which may have an on setting with one or more settings for light brightness and an off setting. The handheld clamp work light may be clamped to an object or may be hung from an object by hook 66 or attached to an object by magnets 75 in clamp member 20 or stand on feet 22 and 24. The light 10 may be powered by batteries 46 or may include a rechargeable power source.

Referring to FIGS. 11 and 12, these figures show the handheld clamp work light 10 clamped to different objects and having light member 12 rotating and/or pivoting in different directions. More specifically, FIG. 11 shows the handheld clamp work light 10 clamped to a pipe and illustrates the pivoting movement of light member 12 to different positions. FIG. 12 shows the handheld clamp work light clamped to an object and illustrates the rotational movement of light member 12.

The handheld work light of the invention provides for an easy to use light capable of directing the light to specific areas of use of a work area. The handheld clamp work light is easy to use and handle.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A handheld clamp work light comprising a light member comprising a light source, a power source for the light source and a switch for turning the light source on and off, a housing member attached to the light source for providing vertical pivoting movement of the light source and 360 degree rotational movement of the light source wherein the housing member comprises an upper flat member and a downwardly extending member having a length and a width less than said upper flat member, a handle member having a handle housing and a clamping member, the handle housing having a top wall upon which said upper flat member seats, said top wall further having an opening adapted to receive said downwardly extending member and attach said handle housing to the housing member and upon which the housing member is adapted to vertically pivot, the handle member further comprising a feet member adapted to pivot in relation to the handle member wherein said feet member extends downwardly from said handle housing and is in the same plane as said handle housing, the clamping member attached to the handle housing and adapted to move in relation to the handle housing for clamping of the handle member to an object, the clamp member further comprising a feet member adapted to pivot in relation to the clamp member wherein said feet member extends downwardly from said clamping member and is in the same plane as said clamping member, and wherein front, rear, sides, top and bottom portions of the handheld clamping work light provide for a substantially rectangular configuration.

2. The handheld clamp work light of claim 1 wherein the light source further comprises a hook member adapted to attach the handheld clamp work light to an object.

3. The handheld clamp work light of claim 1 wherein the clamp member further comprises one or more magnets adapted to attach the handheld clamp work light to an object.

4. The handheld clamping work light of claim 2 wherein the clamp member further comprises one or more magnets adapted to attach the handheld clamp work light to an object.

5. The handheld clamp work light of claim 1 wherein the feet members further comprise V-shaped rubber feet plates.

6. The handheld clamp work light of claim 5 wherein the feet members further comprise a cross-checkered pattern.

7. The handheld clamp work light of claim 1 wherein the light source comprises a LED COB light source.

8. The handheld clamp work light of claim 1 wherein the handle member further comprises a torsion spring attached to the handle housing and the clamping member.

9. The handheld clamp work light of claim 1 wherein the vertical pivoting movement is a ratcheting movement and the rotational movement is a ratcheting movement.

10. A handheld clamp work light comprising a light member comprising a light source, a power source for the light source and a switch for turning the light source on and off, a housing member attached to the light source for providing vertical pivoting movement of the light source and rotational movement of the light source wherein the housing member comprises an upper flat member and a downwardly extending member having a length and a width less than said upper flat member, a handle member having a handle housing and a clamping member, the handle housing having a top wall upon which said upper flat member seats, said top wall further having an opening adapted to receive said downwardly extending member and attach said handle housing to the housing member and upon which the housing member is adapted to vertically pivot, the handle member further comprising a feet member adapted to pivot in relation to the handle member wherein said feet member extends downwardly from said handle housing and is in the same plane as said handle housing, the clamping member attached to the handle housing and adapted to move in relation to the handle housing for clamping of the handle member, the clamp member further comprising a feet member adapted to pivot in relation to the clamp member wherein said feet member extends downwardly from said clamping member and is in the same plane as said clamping member, the light source further comprises a hook member adapted to attach the handheld clamp work light to an object, the clamp member further comprises one or more magnets adapted to attach the handheld clamp work light to an object, and wherein the handheld work light is adapted to be held by a user, clamp to an object, to be attached to an object by the hook member, to be attached to an object by the one or more magnets or to stand on the feet members.

11. The handheld clamp work light of claim 10 wherein the feet members further comprise V-shaped rubber feet plates.

12. The handheld clamp work light of claim 11 wherein the feet members further comprise a cross-checkered pattern.

13. The handheld clamp work light of claim 10 wherein the light source comprises a LED COB light source.

14. The handheld clamp work light of claim 10 wherein the handle member further comprises a torsion spring attached to the handle housing and the clamping member.

15. The handheld clamp work light of claim 10 wherein the vertical pivoting movement is a ratcheting movement and the rotational movement is a ratcheting movement.

16. The handheld clamp work light of claim 10 wherein front, rear, sides, top and bottom portions of the handheld clamping work light provide for a substantially rectangular configuration.

* * * * *